United States Patent [19]

Reynolds et al.

[11] 4,129,965

[45] Dec. 19, 1978

[54] SAFETY CRANK ASSEMBLY FOR RAILROAD BOX CAR PLUG-TYPE DOORS

[76] Inventors: Clarke Reynolds, 16 St. Bernard La., Tiburon, Calif. 94920; Richard J. Quigley, 25538 Adobe La., Los Altos Hills, Calif. 94022

[21] Appl. No.: 885,485

[22] Filed: Mar. 13, 1978

[51] Int. Cl.[2] ..... E05D 15/10

[52] U.S. Cl. ..... 49/220

[58] Field of Search ..... 49/220, 219, 218, 426, 49/217, 216

[56] References Cited

U.S. PATENT DOCUMENTS

| | | | |
|---|---|---|---|
| 2,765,502 | 10/1956 | Torburn | 49/219 |
| 3,913,269 | 10/1975 | Ross, Jr. | 49/220 |
| 4,043,078 | 8/1977 | Dyche et al. | 49/220 |
| 4,048,755 | 9/1977 | Wolak et al. | 49/220 X |

*Primary Examiner*—Kenneth Downey
*Attorney, Agent, or Firm*—Lowhurst & Aine

[57] ABSTRACT

A safety crank assembly for railroad box car plug doors which is mounted between the door, intermediary of the operating crank assemblies, and the retainer track above the door. The safety crank assembly includes a crank arm having an end portion for engaging the retainer track. The engaging end portion is provided with a shuttle which has a rearwardly positioned and downwardly extending skirt which, in case of failure, exerts a load on a portion of the lower shelf of the track which is located much nearer to the side of the car than the crank arm itself would exert on the shelf in case of failure. The upper portion of the shuttle slides in a U-shaped channel at the top of the retainer track to keep it from rotating with rotation of the crank and exerts a load on the downwardly extending shelf of the U-shaped channel of the retainer.

11 Claims, 14 Drawing Figures

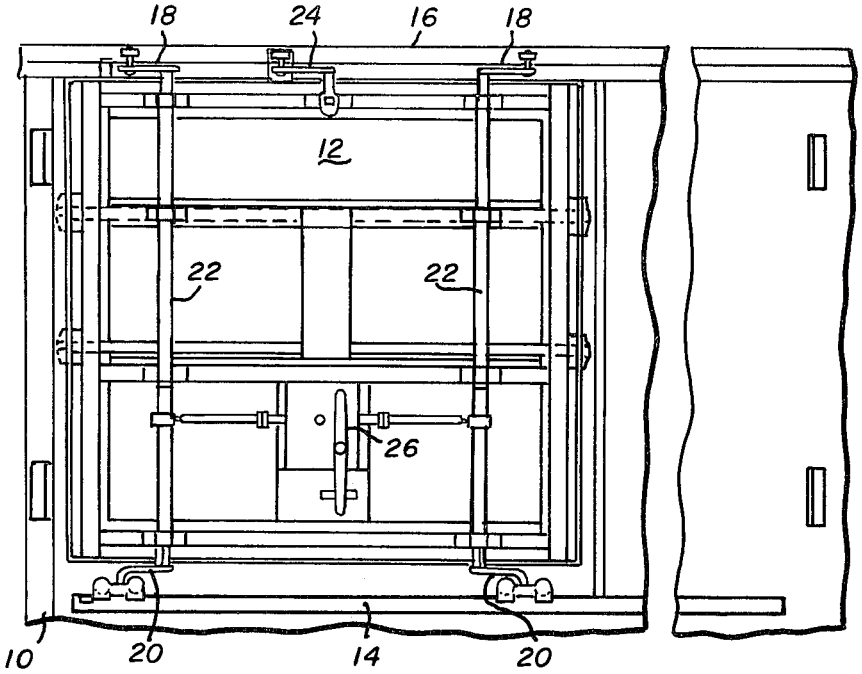
Fig_1
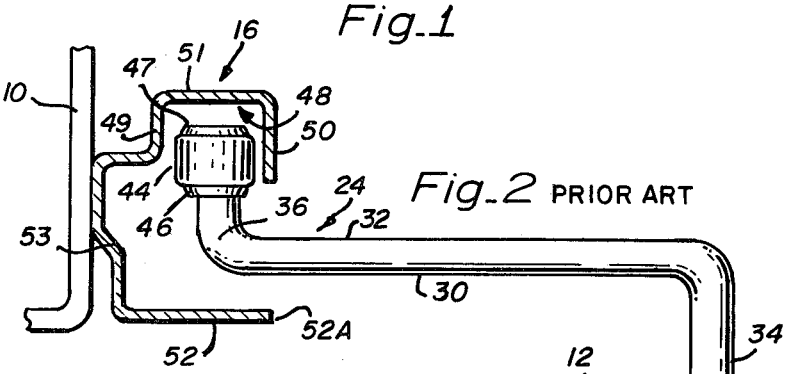
Fig_2 PRIOR ART
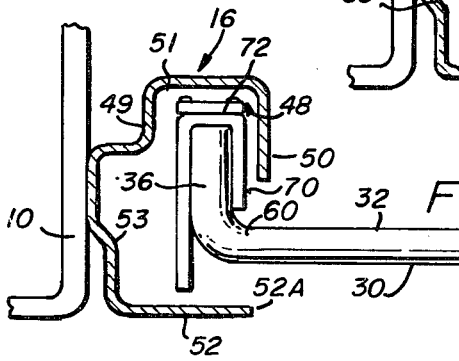
Fig_3A
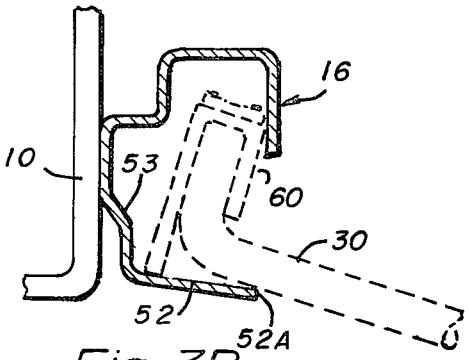
Fig_3B
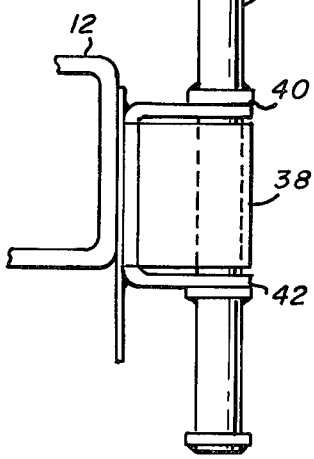

SAFETY CRANK ASSEMBLY FOR RAILROAD BOX CAR PLUG-TYPE DOORS

BACKGROUND OF THE INVENTION

This invention relates to a safety device for a plug door used in railroad box cars, and more particularly to a safety crank assembly that is mounted between the plug door and the retainer track above the door to prevent the plug door from falling off the car in case of failure of the normal operating crank assemblies.

Safety crank assemblies for plug doors have been known for some time and one embodiment thereof is described in U.S. Pat. No. 3,913,269 which issued on Oct. 21, 1975 for "Safety Cranks for Plug Doors". The described assembly includes a safety crank arm which has a horizontal center portion, and a downwardly and an upwardly extending end portion. The downwardly extending end portion is pivotally mounted to the door and the upwardly extending end portion is provided with a roller which engages the U-shaped channel in the retainer track.

While the safety crank assembly configuration described in U.S. Pat. No. 3,913,269 has been found fairly satisfactory, it is unable, for reasons explained hereinafter, to support over 9,000 pounds vertically and 5,000 pounds horizontally, these being the requirements set forth in a new set of regulations adopted by the Association of American Railroads.

One of the reasons that this prior art safety crank assembly is unable to meet these specifications, as will become better understood hereinafter, is due to the fact that in case of failure, the lower horizontal shelf of the retainer track must take the entire load of the plug door, and the load is exerted by the horizontal portion of the safety crank directly on the unsupported edge of the shelf. This exerts a very considerable bending moment on the shelf which causes it to bend and which makes it unable to comply with the new load specifications. Of course, it may be possible to strengthen the lower shelf by making it from a heavier gauge metal, say ¼ inch or heavier instead of the present 3/16 inch or 1/4 inch, but this would require the retrofitting of many hundred thousands of railroad freight cars with new and heavier retainer tracks which is not economical. Also, and ignoring the new requirements of the Association of American Railroads, it is always desirable to have a safety crank assembly that provides a maximum margin of safety.

SUMMARY OF THE INVENTION

It is therefore an object of the present invention to provide a safety crank assembly that can cooperate with existing retainer tracks and is able to take considerably greater vertical and horizontal loads than heretofore possible.

It is another object of the present invention to retrofit existing safety crank arms with a minimum expense to provide a substantially greater horizontal and vertical load resistance than those devices using a roller for engaging the retainer track.

It is still a further object of the present invention to provide a simple, economical, and efficient means for the upper end portion of the crank arm of a safety crank assembly arm for engaging a retainer track which provides considerably greater safety in retaining a door in case of failure of the operative crank assemblies.

In accordance with the present invention, the normally used roller on the upwardly extending portion of the crank arm, which engages the retainer track is replaced by a shuttle which has a downwardly depending skirt whose lower end portion is either in contact with or closely spaced from the lower shelf and maintained in a position between the crank arm and the car. This is accomplished by rotatively mounting the shuttle on the upwardly extending portion of the crank arm with the upper portion being dimensioned for engaging the upper U-shaped channel which retains the shuttle against rotation. In case of failure of the door supporting mechanism, the door will angle at approximately 3° and instead of the horizontal portion of the crank arm exerting a large bending moment on the horizontal shelf of the retainer track, the skirt of the shuttle contacts the shelf at a position which is considerably more inward than the shelf end, and thereby exerts a considerably smaller bending moment on the shelf. Because of this smaller bending moment, the load retaining capacity of the shelf is considerably greater than direct contact of the horizontal portion of the crank arm on the shelf edge.

BRIEF DESCRIPTION OF THE DRAWINGS

FIG. 1 is a front elevation of a typical railroad box car plug door showing the location of the safety crank assembly of the present invention, FIG. 2 is a side view of a prior art safety crank assembly engaging the cooperating retainer track, FIG. 3A is a side view of one embodiment of a safety crank assembly constructed in accordance with the present invention engaging the cooperating retainer track, FIG. 3B is a side view, like that of FIG. 3A, of the upper crank assembly in case of failure in phantom outline in the cooperating retainer track.

DETAILED DESCRIPTION OF THE PREFERRED EMBODIMENT

Figure 4:
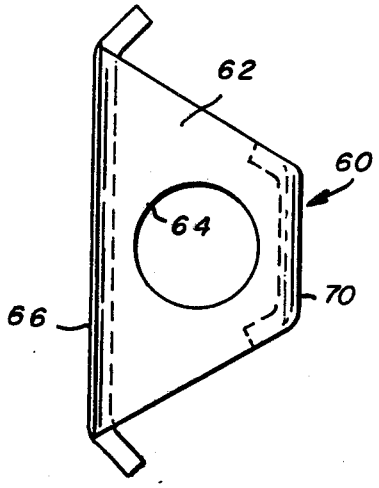
FIGS. 4–6 are, respectively, top, side and front views of the shuttle shown in FIG. 3A and 3B, FIGS. 7–9 are, respectively, top, side and front views of another embodiment of a shuttle that can be used with the safety crank shown in FIG. 3A.

Referring now to FIG. 1 of the drawing, there is shown the side of a railroad box car 10 having a plug-type door 12 mounted in place. While door 12 is held in place by the opening in box car 10 when the door is in its closed position, other means are provided to allow it to be opened and moved parallel to the side of box car 10 to expose the opening. To this end there is provided a roller track 14 at the lower end and a retainer track 16 on the other end. Door 12 is also provided with a pair of operative crank assemblies comprising upper crank assemblies 18 and lower crank assemblies 20 which are connected to one another by connecting pipe 22. Rotation of connecting pipe 22 in one direction, as is well-known to those skilled in the art, will move the door into the opening and in the other direction will move the door out of the opening so that it can be moved along roller track 14 to expose the opening. There is also provided a safety crank assembly 24 which will be explained in more detail hereinafter. Operation of the crank arm assembly is accomplished by moving operating lever 26 which upon being rotated, will rotate connecting pipes 22.

Referring now to FIG. 2 of the drawing, there is illustrated a prior art safety crank assembly 24 engaging door 12 and retainer track 16. More particularly, safety crank assembly 24 includes a crank arm 30 which has a horizontal portion 32, a downwardly extending vertical end portion 34 and an upwardly extending vertical end portion 36. Crank arm portion 34 is rotatably mounted by means of a fulcrum 38 to box car door 12 by welding the fulcrum to the side of the door and welding a pair of cylindrical retainer rings 40 and 42 to the crank arm, one on one side of fulcrum 38 and the other on the other side of the fulcrum. In this manner, crank arm 30 is free to rotate, but is restrained from moving vertically with respect to door 12.

Vertical end portion 36 is provided with a roller 44 which is rotatably mounted thereon and held in place by a pair of cylindrical retainer rings 46 and 47. Retaining track 16 includes an upper U-shaped channel 48 formed by two parallel vertical side walls 49 and 50 and top wall 51. The retainer track also has a lower horizontal shelf 52 which is connected by connecting wall 53 to vertical wall 49. Roller 44 is dimensioned to freely roll in guiding relation in channel 48 and end portion 36 is dimensioned to protect the roller into the channel.

In case of failure of the operative crank assembly, door 12 is held to the side of car 10 by safety crank arm assembly 24. As the operative crank assemblies fail, door 12 will fall down and out to make approximately an angle of 3° with the box car side wall. This causes horizontal crank arm portion 32 to bear down on edge 52A of shelf 52 and thereby to exert a considerable bending moment on shelf 52 which will deflect it downwardly. When the force on the edge of shelf 52 is great enough, it may deflect shelf 52 sufficiently so that the upper portion 36 of the safety crank assembly will slip out of retainer track 16 to thereby release the door entirely from the box car which would be a failure of the safety feature. As is readily understood, the weak point of the safety crank assembly of the prior art is that a large bending moment exerted on the shelf causes a deflection of shelf 52 which gives rise to failure.

Figure 5:
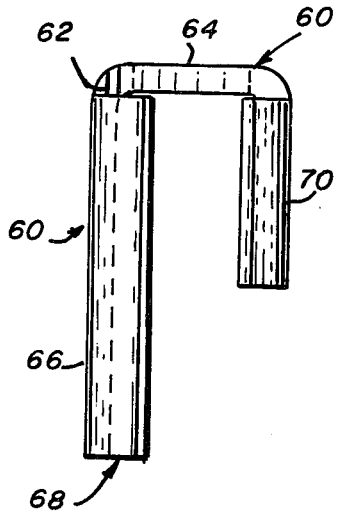
Figure 6:
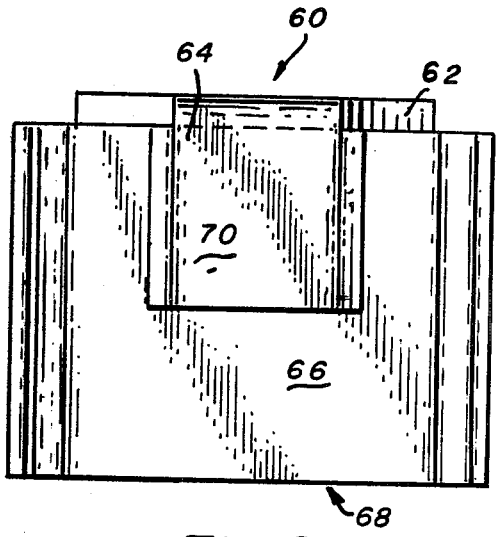

Referring now to FIG. 3A of the drawing, in which like reference characters designate like parts, there is shown a shuttle 60 rotatably affixed to the end portion 36 of crank arm 30 instead of roller 44. As best seen in FIGS. 4–6, shuttle 60 includes a horizontal portion 62 having an opening 44 which is dimensioned to accommodate, rotatably, crank arm portion 36. Horizontal portion 62 is connected to a vertical, downwardly depending rear wall or skirt 66 which is load bearing and which has an end surface 68. Shuttle means 60 also has a vertical, downwardly depending front wall 70 which is substantially parallel to wall 66 and which is provided to securely maintain rear wall 66 of shuttle means 60 parallel to the side wall of the box car when crank arm portion 36 turns. In other words, rear wall 66 and front wall 70 maintain shuttle 60 in the U-shaped channel 48.

Referring now again to FIG. 3, shuttle means 60 is placed over crank arm portion 36, and a cylindrical retainer ring 72, having an opening to fit crank arm 36, is welded to crank arm portion 36 to secure shuttle 60 against vertical movement in an upward direction with respect to crank arm 30. Front wall 70 of shuttle means 60 has a length selected to bear against the upper surface of horizontal portion 32 to secure shuttle 60 against vertical movement in the downward direction with respect to crank arm 30. It is to be understood that there are many other means of securing shuttle 60 to crank arm portion 36 so that it is prevented from moving vertically in an upward and downward direction with respect to the crank arm and yet is able to rotate about crank arm portion 36. Also, the flat-to-flat distance between the outer surfaces of vertical walls 66 and 70 is selected so that shuttle 60 fits into channel 48 and is retained therein for sliding and against rotation to maintain wall 66 as close as possible to the box car side wall.

End wall 66 has a length that is selected as long as possible so that lower surface 68 is either in contact with the upper surface of shelf 52 or is spaced therefrom a small distance. The longer the front wall 66, i.e., the greater the extension of wall 66 below the lowest part of horizontal portion 32 of crank arm 30, the greater is the effectiveness of the invention which will now be explained.

In operation, when the operative crank arm assemblies hold plug door 12 properly in place, shuttle 60 will slide inside retaining track 16 while maintaining its rotational orientation by means of U-shaped channel 48 as crank arm 30 rotates when door 12 is moved with respect to box car 10. This means that wall 66 is maintained always as close as possible to the wall of box car 10. In case of failure of the operative crank arm assemblies, the door has a tendency to drop down and out, a position of crank arm 30 and shuttle means 60 which is illustrated in phantom outline in FIG. 3B. As is immediately seen, particularly if compared with the prior art device shown in FIG. 2, surface 69 bears on shelf 52 very close to connecting wall 53 and therefore will exert a much lesser bending moment on shelf 52 than the device of the prior art. It is true that there may be some deflection, depending on the length of wall 66, because horizontal portion 32 of crank arm 30 may bear to some extent on edge 52A, but the resulting bending moment is still very much less and therefore the load that can be carried by retainer 16, through crank arm 30, is very much greater than was possible heretofore.

Figure 7:
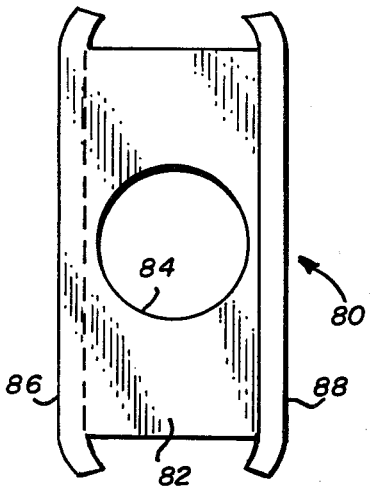
Figure 8:
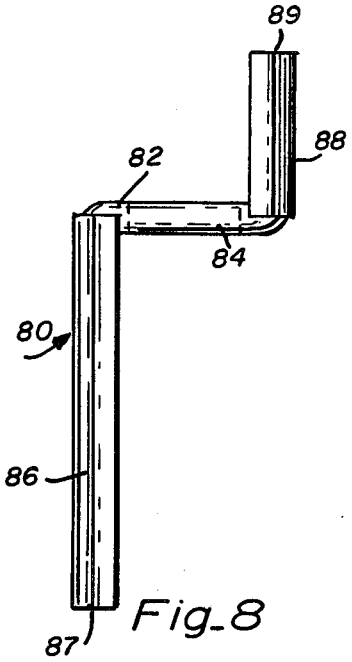
Figure 9:
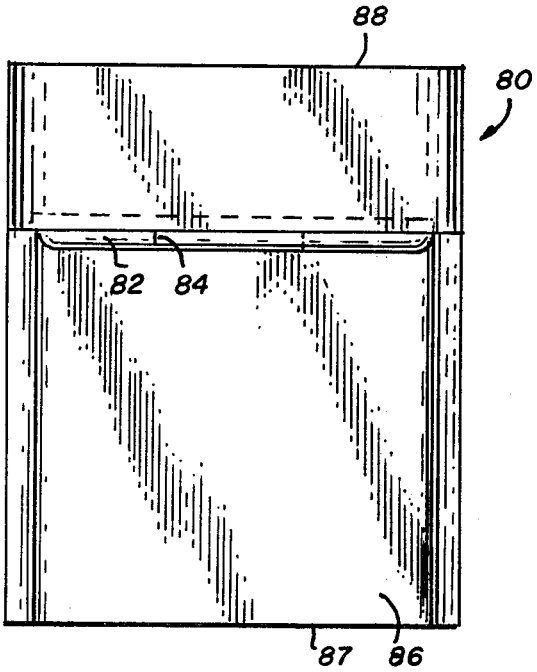

Referring now to FIGS. 7–9, there is shown another embodiment of a shuttle 80 which is similar to shuttle 60 except that the front wall extends upwardly instead of downwardly and that therefore the horizontal portion, which connects the front and rear wall, must be lower. Shuttle 80 includes a horizontal portion 82 having an opening 84 therein which is dimensioned to fit over upper crank portion 36. Horizontal portion 82 has a vertical, downwardly dependent rear wall 86 and a vertical, upwardly dependent front wall 88. As before, the distance between the outer surfaces of rear wall 86 and front wall 88 is selected so that shuttle 80 fits into U-shaped channel 4 in which it can slide without being rotated.

Figure 10:
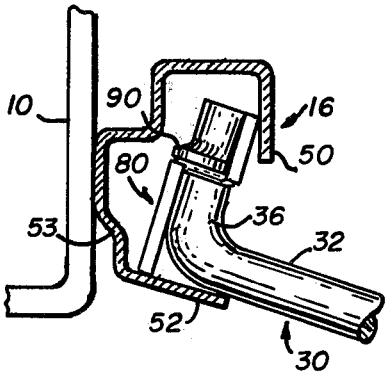
FIG. 10 is a side view, like that of FIG. 3B, of the upper crank assembly using the shuttle of FIGS. 7–9 in case of failure in phantom outline in the cooperating retainer track.

As best seen in FIG. 10, shuttle 80 is mounted on upper crank arm portion 36 of crank arm 30 by placing opening 84 over the crank arm. A retainer washer 90 is welded in place on crank arm portion 36, above horizontal portion 82, to secure shuttle 80 against vertical displacement in case of failure. FIG. 10 also illustrates that in case of failure, the lower surface 87 of rear wall 86 bears against the upper surface of shelf 52, at a place close to connecting wall 53, to thereby reduce the bending moment applied to shelf 52. The action of shuttle 80 is similar to the action to shuttle 60 and the same considerations as to the length of downward extension of rear wall 86 below the horizontal crank arm portion 32 apply. In fact, in shuttle 80 the total distance between the lower surface 87 of rear wall 86 and upper surface 89 of front wall 88 is substantially the same as the total distance in shuttle 60 between lower surface 69 of rear wall 66 and the upper surface of horizontal portion 62. FIG. 10 also shows that, in case of failure, safety crank arm 30 changes its attitude and that surface 87 exerts a downward load on the inner edge of shelf 52, thereby exerting a lesser bending moment on the shelf that would have been exerted if no shuttle had been present. Likewise, the upper corner of front wall 88 exerts a horizontal force on wall 50 which exerts a somewhat lesser bending moment than would have been exerted by roller 44 of FIG. 2. Even though there is some bending of lower shelf 52, such bending can be further reduced by either shortening shelf 52 or lengthening rear wall 86.

Figure 11:
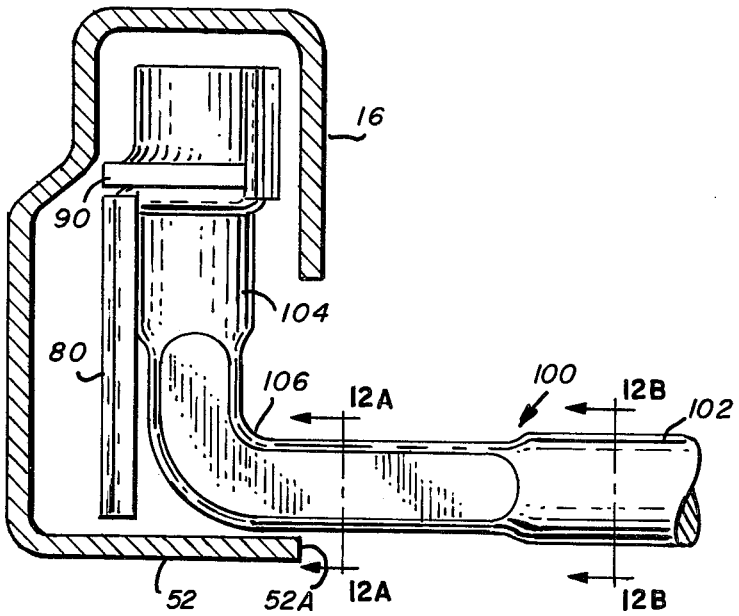
FIG. 11 is a side view of another embodiment of a safety crank assembly constructed in accordance with the present invention engaging the cooperating retainer track.
Figure 12A:
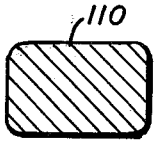
FIGS. 12A and 12B are cross sectional views taken along lines 12A—12A and 12B—12B, respectively, of FIG. 11.
Figure 12B:
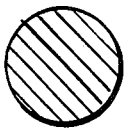

Referring now to FIGS. 11, 12A and 12B, there is shown a further embodiment of the safety crank arm of this invention, utilizing a shuttle like shuttle 80 in a retainer 16. As can be seen from FIGS. 3B and 10, in the event of failure of the operative crank assemblies, the plug door falls outwardly and downwardly causing the lower surface of horizontal portion 32 of crank arm 30 to bear against edge 52A of shelf 52, causing the same to slightly bend downwardly. It is clear that if horizontal portion 32 is circular in cross section, the contact area between it and the edge of shelf 52 is essentially a point contact and the circular cross section does not readily bend to soften the impact in case of failure.

To lengthen the contact and to provide a more yielding crank, there is provided a crank arm 100 having a horizontal portion 102 and an upwardly extending portion 104. The portion between horizontal portion 102 and vertical portion 104 defines a bent section 106 which is made to have a substantially rectangular cross section, as shown in FIG. 12A. Vertical portion 104 and horizontal portion 102 are of conventional circular cross section, as shown in FIGS. 12B. As can be seen, in case of failure the contact between crank arm 100 and edge 52A of horizontal shelf 52 is a line contact which distributes the load over a substantial portion of edge 110 rather than concentrating the load on a point. As a practical matter, the rectangular cross section is obtained by swaging the crank arm prior to bending the same. Another advantage of the rectangular cross section, which is purposely made wider in the horizontal direction than in the vertical direction, is that it provides some elasticity of yielding in case of door failure caused by the ability of the rectangular cross section portion to bend slightly when contacting shelf 52.

There has been described the use of a shuttle, such as 60 or 80, with a safety crank arm as a replacement for roller 44, which is economical, simple and allows a much greater margin of safety by considerably increasing the allowable weight that may be safely supported by the crank arm assembly of the present invention utilizing the standard retainer track.

What is claimed is:

1. For a plug-type railroad box car door which is supported for movement in and out of a door opening in the car by means of a pair of spaced apart operating crank assembly means higher lower operating crank assemblies for engaging a roller track and upper operating crank assemblies for engaging a retainer track having an upper U-shaped channel and a lower horizontal shelf, the improvement of a safety crank assembly mounted between said door, intermediary of said operating crank assembly, and said retainer track to prevent said door from disengaging from the car in the event of failure of said operating crank assembly means, said safety crank assembly comprising;

a crank arm having a substantially horizontal center portion and two oppositely extending vertical end portions;

door means for rotatably securing one vertical end portion of said crank arm to said door;

shuttle means rotatably engaging the other vertical end portion of said crank arm for slidingly supporting said other vertical end portion within said retainer track;

said shuttle means including a rearwardly positioned and downwardly depending load bearing skirt having a length selected such that, in case of failure of said operative crank assemblies, the lower end of said skirt bears on the upper surface to the lower horizontal shelf of said retainer track at a point which is spaced closer to the side wall of the car than the edge of said shelf to exert a substantially smaller bending movement on said shelf than would be exerted by the horizontal portion of said crank arm in the absence of said shuttle means; and the upper end of said shuttle means being shaped and dimensioned to slidingly and nonrotatably engage the upper U-shaped channel of said retainer track to maintain said skirt in substantially the same rearward position independent of the rotational position of said crank arm.

2. A safety crank arm assembly in accordance with claim 1 which further includes means to secure said shuttle means to said other vertical end portion to limit relative displacement therebetween to rotational displacement.

3. A safety crank arm assembly in accordance with claim 2 in which said shuttle means includes an opening for rotatably engaging said other vertical end portion to secure said shuttle means against lateral motion and in which said securing means includes a washer means affixed to said crank arm to secure said shuttle means against vertical motion in an upward direction.

4. A safety crank arm assembly in accordance with claim 3 in which said securing means further includes a forwardly positioned and downwardly dependent load bearing skirt integral with said shuttle means having a length selected to bear on said horizontal center portion of said crank arm when said shuttle means is substantially in contact with said washer means, said forwardly positioned skirt securing said shuttle means against vertical motion in a downward direction.

5. A safety crank arm assembly in accordance with claim 4 in which said forwardly positioned and said rearwardly positioned skirts are substantially parallel and are spaced apart a distance for sliding and nonrotational engagement with the U-shaped channel of the retainer track.

6. A safety crank arm assembly in accordance with claim 3 in which said shuttle means further includes a forwardly positioned and upwardly dependent skirt having a length selected so that the end face thereof is substantially at the same height as the end face of said other vertical end portions of said crank arm.

7. A safety crank arm assembly in accordance with claim 6 in which said forwardly positioned and said rearwardly positioned skirts are substantially parallel and are spaced apart a distance for sliding and nonrotational engagement with the U-shaped channel of the retainer track.

8. A safety crank arm assembly in accordance with claim 1 in which said shuttle means further includes, a forwardly positioned and downwardly extending skirt, and a horizontal portion for connecting said rearwardly and forwardly positioned skirts, said horizontal portion including an opening dimensioned for rotatably engaging said other vertical end portion of said crank arm, the distance between the upper surface of said horizontal portion and the lower end face of said rearwardly positioned skirt being selected so that said surfaces are spaced from the opposing surface in the retainer track, and means for restraining said shuttle means for at least moving in an upward direction.

9. A safety crank arm assembly in accordance with claim 1 in which said shuttle means further includes a forwardly positioned and upwardly extending skirt, and a horizontal portion for connecting said rearwardly and forwardly positioned skirts, said horizontal portion including an opening dimensioned for rotatably engaging said other vertical end portion of said crank arm, the distance between the upper end face of said forwardly/-positioned portion and the lower end face of said rearwardly positioned skirt being selected so that said surfaces are spaced from the opposing surfaces in the retainer track, and means for restraining said shuttle means from at least moving in an upward direction.

10. A safety crank arm assembly in accordance with claim 1 in which said rearwardly positioned skirt is dimensioned and located so that, in case of failure, the lower end of said skirt bears on the upper surface of the lower horizontal shelf of said retainer track at a point which is closer to the side wall of the car than to the edge of the shelf.

11. A safety crank arm assembly in accordance with claim 10 in which the point at which the lower surface of said rearwardly positioned skirt bears on the upper surface of said lower shelf is selected to be as close as possible to the side wall of the car.

* * * * *